US012780490B2

(12) United States Patent
Kadota et al.

(10) Patent No.: US 12,780,490 B2
(45) Date of Patent: Nov. 3, 2026

(54) CUSHIONING MATERIAL

(71) Applicant: PANASONIC HOLDINGS CORPORATION, Osaka (JP)

(72) Inventors: Koji Kadota, Tokyo (JP); Kenji Hattori, Shiga (JP); Masato Murakata, Hyogo (JP); Youhei Matsuda, Hyogo (JP); Yusuke Okazaki, Osaka (JP)

(73) Assignee: PANASONIC HOLDINGS CORPORATION, Osaka (JP)

( * ) Notice: Subject to any disclaimer, the term of this patent is extended or adjusted under 35 U.S.C. 154(b) by 0 days.

(21) Appl. No.: 19/054,137

(22) Filed: Feb. 14, 2025

(65) Prior Publication Data

US 2025/0187784 A1 Jun. 12, 2025

Related U.S. Application Data

(63) Continuation of application No. PCT/JP2023/027710, filed on Jul. 28, 2023.

(30) Foreign Application Priority Data

Aug. 31, 2022 (JP) ..... 2022-137960

(51) Int. Cl.
*B65D 5/50* (2006.01)

(52) U.S. Cl.
CPC ..... *B65D 5/5038* (2013.01)

(58) Field of Classification Search
CPC ..... B65D 5/5038; B65D 5/5035; B65D 81/05
USPC ..... 206/557, 433; 229/173
See application file for complete search history.

(56) References Cited

U.S. PATENT DOCUMENTS

| | | | | |
|---|---|---|---|---|
| 11,643,244 | B2 * | 5/2023 | Valencia | B65D 5/5038 206/557 |
| 2010/0187149 | A1 | 7/2010 | Tsukii et al. | |
| 2013/0092588 | A1 * | 4/2013 | Aksan | B65D 5/4295 73/849 |

FOREIGN PATENT DOCUMENTS

| | | | |
|---|---|---|---|
| JP | H01126918 | U | 2/1989 |
| JP | H01126918 | * | 8/1989 |
| JP | H03111921 | U | 11/1991 |
| JP | H086738 | B2 * | 1/1996 |
| JP | 2008308178 | A | 12/2008 |
| JP | 2018008730 | * | 1/2018 |
| JP | 2018008730 | A | 1/2018 |

(Continued)

OTHER PUBLICATIONS

International Search Report for corresponding Application No. PCT/JP2023/027710, issued Sep. 19, 2023, with English translation.

*Primary Examiner* — Rafael A Ortiz
(74) *Attorney, Agent, or Firm* — Renner, Otto, Boisselle & Sklar LLP

(57) ABSTRACT

A cushioning material includes front and rear end walls, and left and right side walls. Each side wall includes an outside wall, and an inside wall folded back to an inner surface side of the outside wall. The inside wall includes a lower portion which includes an inclined supporting portion. The inclined supporting portion is inclined relative to the outside wall such that the inclined supporting portion is further from the outside wall as extending downward to the bottom plate. The inside wall includes a flap provided continuously on the inclined supporting portion and the flap is overlaid on the bottom plate. The flap includes an end portion inserted in a recessed portion of each end wall.

3 Claims, 6 Drawing Sheets

(56) References Cited

FOREIGN PATENT DOCUMENTS

| | | | |
|---|---|---|---|
| JP | 2021075302 | A | 5/2021 |
| JP | 2022143462 | A | 10/2022 |

* cited by examiner

CUSHIONING MATERIAL

CROSS-REFERENCE TO RELATED APPLICATIONS

This application is a continuation of International Application No. PCT/JP2023/027710, filed Jul. 28, 2023, which claims priority to Japanese Patent Application No. 2022-137960, filed on Aug. 31, 2022, the contents of which are hereby incorporated by reference in their entirety.

BACKGROUND

The present disclosure relates to a cushioning material.

A cushioning material made of a cardboard protects an electronic device such as a laptop computer housed in a box body from impact. In this cushioning material, leg plates extend downward from an edge portion of an insert plate, and an electronic device is held on an upper surface of the insert plate (see, for example, Patent Literature 1: JP2008-308178A). Once the aforementioned cushioning material is housed in the box body, the insert plate is apart from a bottom surface of the box body by the leg plates. The electronic device and the bottom surface of the box body define a space therebetween, and the cushioning material protects the electronic device from impact exerting on the box body.

SUMMARY

In the aforementioned cushioning material, since the leg plate tends to fall down, it is difficult to maintain the shape. The present disclosure is directed to a cushioning material which maintains the shape of a portion for supporting a content and enhances the performance of protecting the content.

According to the present disclosure, a cushioning material to be housed in a box body comprises: a bottom plate; front and rear end walls which stand upright from front and rear edge portions of the bottom plate respectively; and left and right side walls which stand upright from left and right edge portions of the bottom plate respectively. Each side wall includes an outside wall which is disposed continuously on an edge portion of the bottom plate; and an inside wall which is disposed continuously on an upper edge portion of the outside wall and is folded back to an inner surface side of the outside wall. The inside wall includes a lower portion which includes an inclined supporting portion for supporting a lower surface of a content. The inclined supporting portion is inclined relative to the outside wall such that the inclined supporting portion is further from the outside wall as extending downward to the bottom plate. The inside wall includes a flap provided continuously on a lower edge portion of the inclined supporting portion and the flap is overlaid on an upper surface of the bottom plate. The flap includes an end portion in a front-rear direction and the end portion is inserted in a recessed portion which is defined by a lower edge portion of each end wall.

In this cushioning material, the end portion of the flap provided continuously on the inclined supporting portion is inserted in the recessed portion of each end wall, so that the lower edge portion of the inclined supporting portion is fixed. This maintains the inclined supporting portion in the inclined position. Then, in this cushioning material, a content housed in an upper space is supported with being apart from the bottom plate by the inclined supporting portion projecting from the side wall. This defines a space between the content and the bottom plate. In this way, in this cushioning material, the space is defined between the content and the bottom plate, and the shape of the inclined supporting portion supporting the content is maintained. This enhances the performance of protecting the content against impact exerting on the box body.

Each end wall of the aforementioned cushioning material includes: an outer end wall which is provided continuously on the edge portion of the bottom plate; and an inner end wall which is provided continuously on an upper edge portion of the outer end wall and is folded back to an inner surface side of the outer end wall. In this case, the recessed portion is defined by a lower edge portion of the inner end wall. This prevents the end portion of the flap from being exposed on an outer surface of the end wall when the end portion of the flap is inserted into the recessed portion.

In the aforementioned cushioning material, each end wall includes an intermediate plate disposed between the upper edge portion of the outer end wall and an upper edge portion of the inner end wall. In this case, the intermediate plate defines an opening portion, and each end wall includes a rib plate provided continuously on an edge portion of the opening portion. Then, the rib plate is folded downward relative to the intermediate plate and is inserted between the outer end wall and the inner end wall. This enhances the strength of the end wall.

This cushioning material allows a content to be housed in the box body with being apart from the bottom plate, and maintains the shape of the inclined supporting portion supporting the content. Therefore, the content is surely protected from impact exerting on the box body.

BRIEF DESCRIPTION OF THE ACCOMPANYING DRAWINGS

DESCRIPTION OF THE EMBODIMENTS

An embodiment of the present disclosure will be described in detail with reference to the drawings as appropriate. In the following description, the up, down, front, rear, left, and right directions are set in convenience for describing the cushioning material of the present embodiment, and are not intended to limit the configuration and a form of use of the cushioning material.

Figure 1:
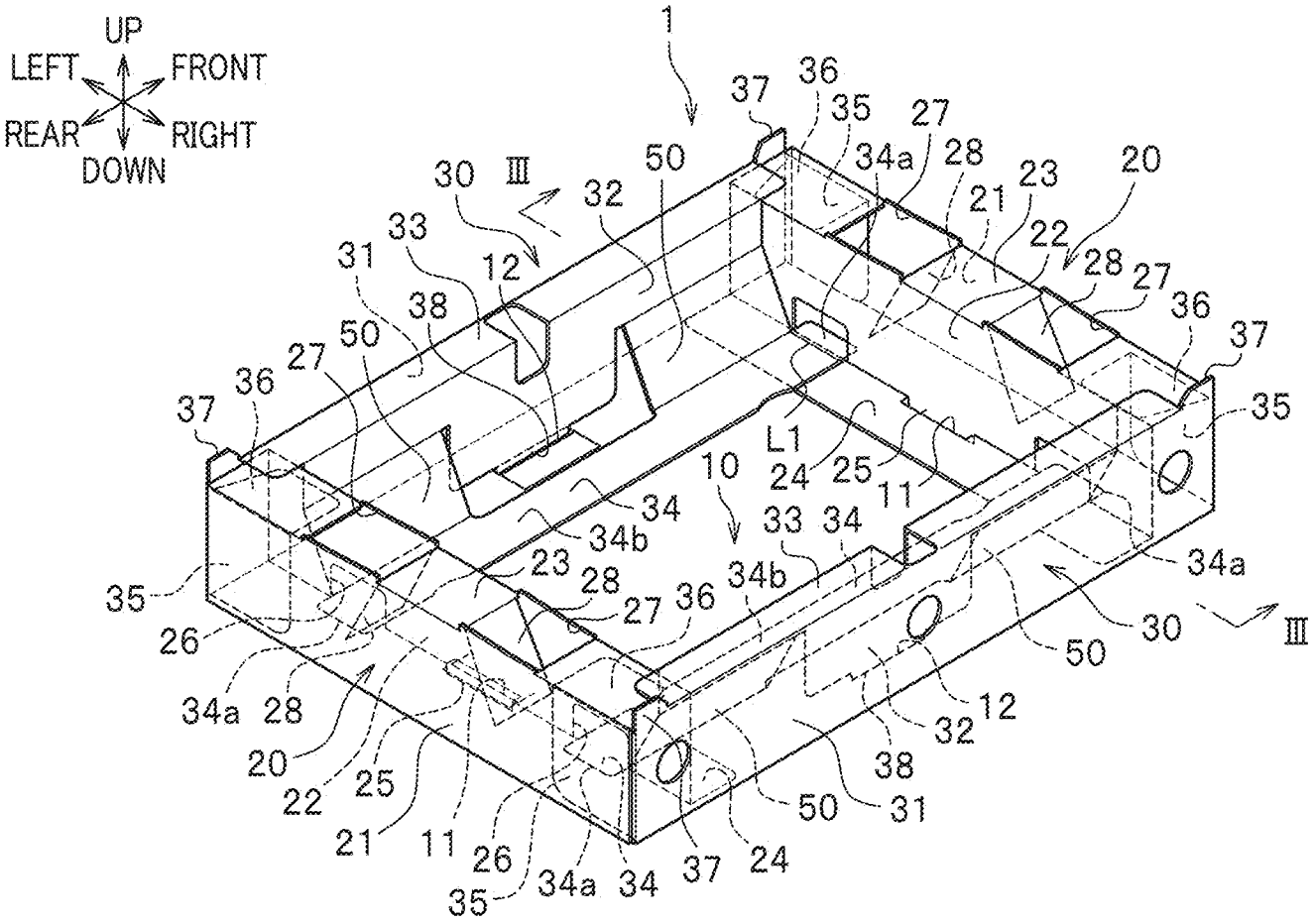
FIG. 1 is a perspective view of a cushioning material according to an embodiment of the present disclosure as viewed from rear upper right.
Figure 3:
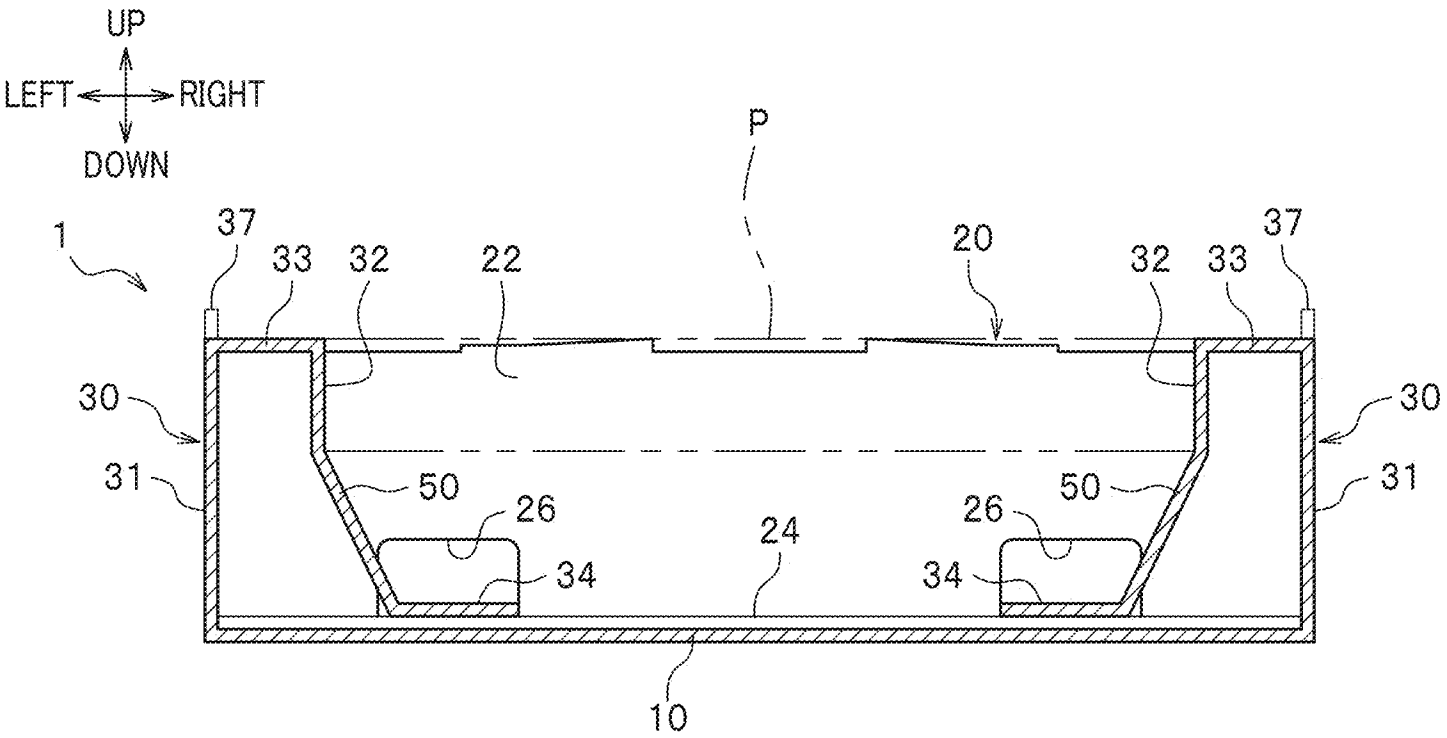
FIG. 3 is a sectional view taken along III-III in FIG. 1, showing the cushioning material according to the embodiment of the present invention.
Figure 4:
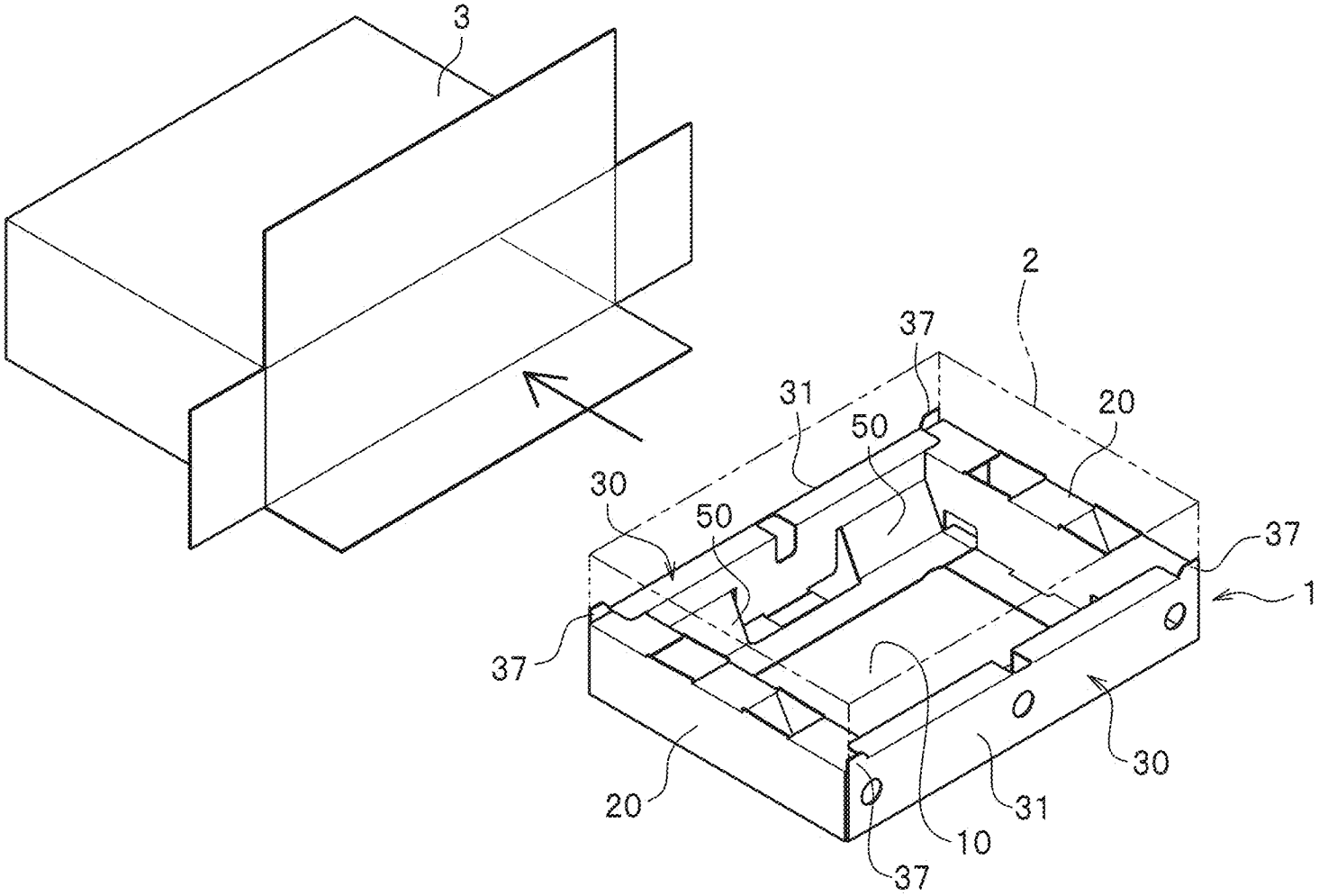
FIG. 4 is a perspective view showing a usage of the cushioning material according to the embodiment of the present disclosure.

As shown in FIG. 1, a cushioning material 1 of the present embodiment includes a bottom plate 10, front and rear end walls 20, 20 raised upright on front and rear edge portions of the bottom plate 10, and left and right side walls 30, 30 raised upright on left and right edge portions of the bottom plate 10. As shown in FIG. 3, the cushioning material 1 protects a content P which is an electronic device such as a laptop computer or a monitor housed in a box body 3. As shown in FIG. 4, the cushioning material 1 of the present embodiment is housed in the box body 3 in a configuration where a container tray 2 is overlaid on an upper surface of the cushioning material 1.

Figure 2:
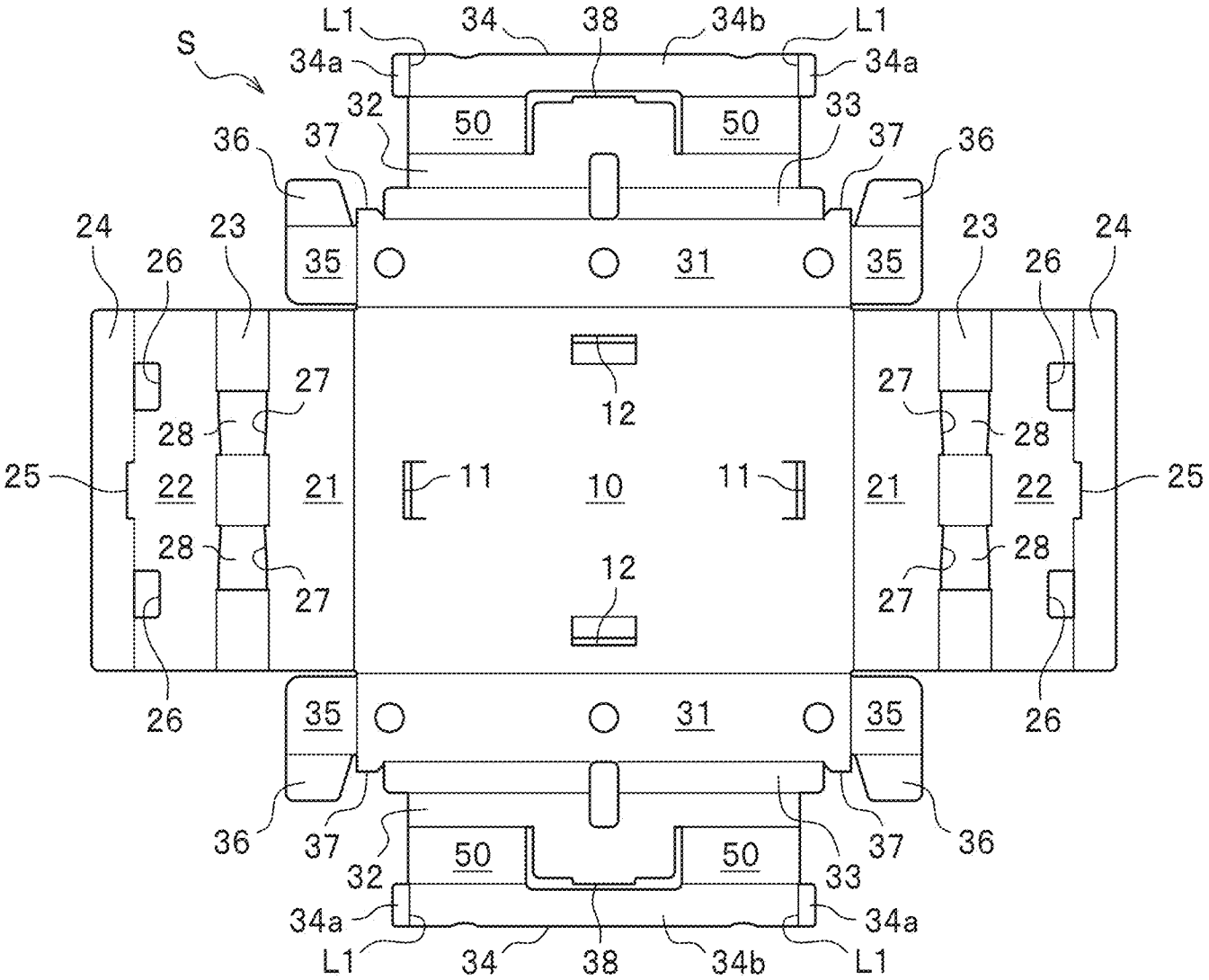
FIG. 2 is a diagram showing a blank sheet of the cushioning material according to the embodiment of the present disclosure.

As shown in FIG. 2, the cushioning material 1 is formed by externally-folding or internally-folding a blank sheet S, which is cut out of a sheet made of a cardboard, along each folding line. The blank sheet S shown in FIG. 2 is disposed such that the inner surface side of the blank sheet S can be seen. The folding lines of the blank sheet S are score lines (creases) formed by pressing the surface of the blank sheet S in the form of lines. Note that the score lines may be formed with intermittent cuts. This makes it easier to fold the blank sheet S along the score lines. In addition, the folding lines may be configured by intermittently and linearly forming half-cuts formed by cutting only the surface of the sheet or by forming cuts through the sheet.

Figure 5:
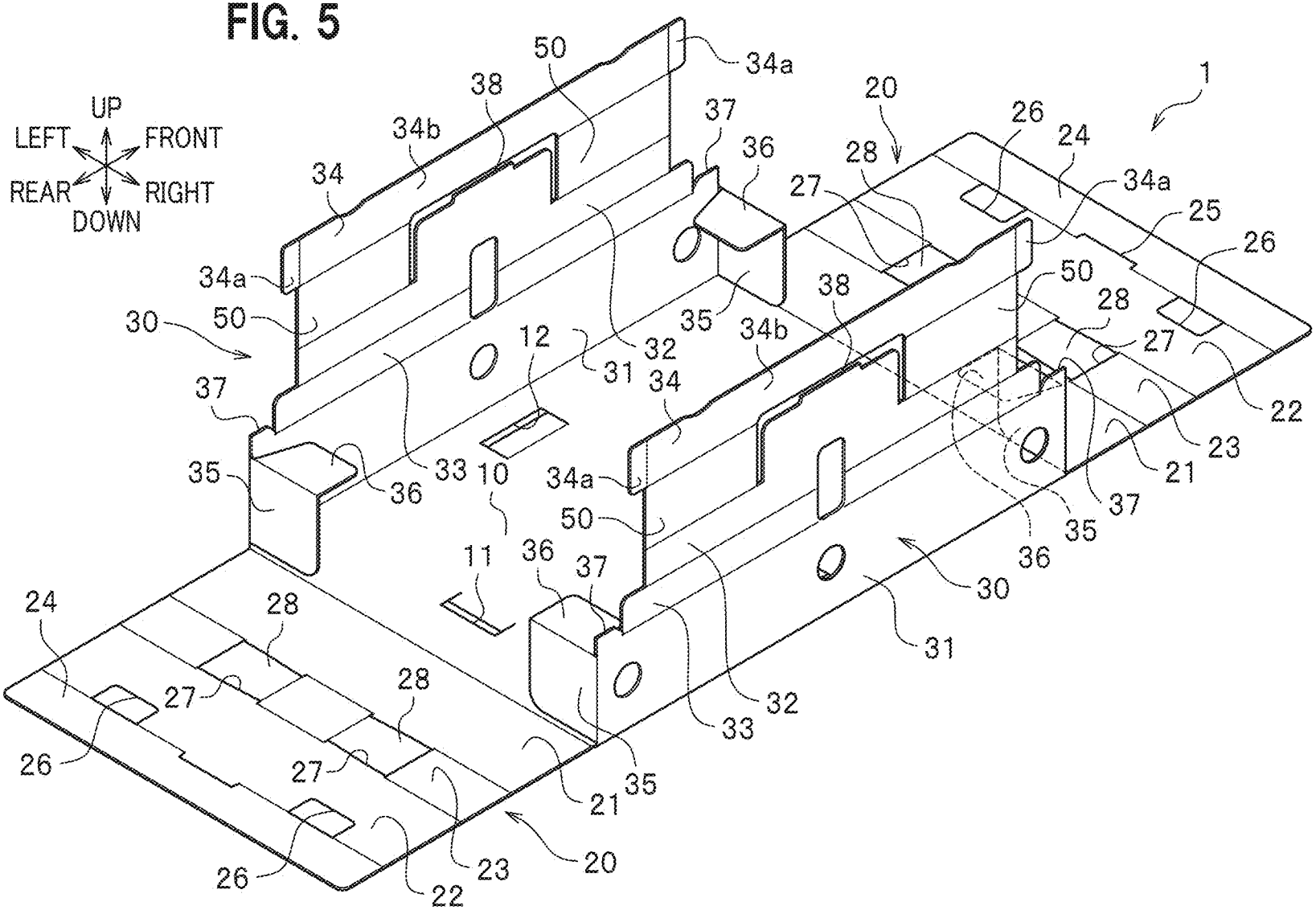
FIG. 5 is a perspective view showing a procedure of assembling the cushioning material according to the embodiment of the present disclosure and showing a configuration where inside walls have been raised upright relative to a bottom plate.

As shown in FIG. 5, the bottom plate 10 is a rectangular flat plate. The bottom plate 10 is a portion which is overlaid on a bottom surface (a surface shown on the lower side in FIG. 4) of a box body 3 (see FIG. 4) when the cushioning material 1 is housed in the box body 3. The bottom plate 10 has the same shape and size as the bottom surface of the box body 3. In a front portion and a rear portion of the bottom plate 10, front and rear first engagement holes 11, 11 (see FIG. 2) extend through the center portions in the left-right direction. In a left portion and a right portion of the bottom plate 10, left and right second engagement holes 12, 12 (see FIG. 2) extend through the center portions in the front-rear direction.

Figure 6:
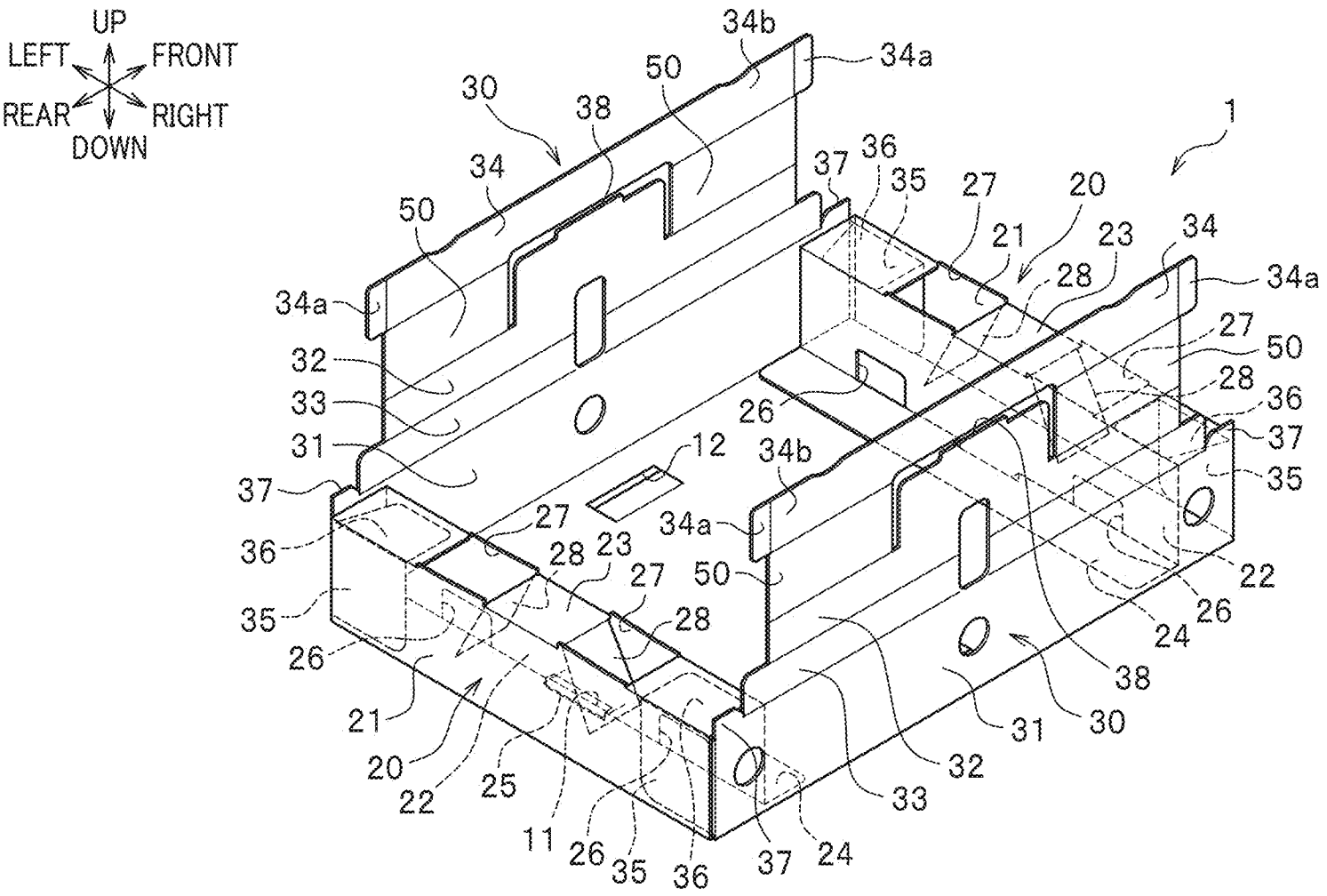
FIG. 6 is a perspective view showing the procedure of assembling the cushioning material according to the embodiment of the present disclosure and showing a configuration where end walls have been built.

As shown in FIG. 6, the end wall 20 on the front side includes an outer end wall 21 provided continuously on a front edge portion of the bottom plate 10, an inner end wall 22 disposed inward of the outer end wall 21, and a first intermediate plate 23 disposed between the upper edge portion of the outer end wall 21 and the upper edge portion of the inner end wall 22. The end wall 20 includes a first flap 24 is provided continuously on the lower edge portion of the inner end wall 22.

The outer end wall 21 is provided continuously on the front edge portion of the bottom plate 10, with the folding line interposed therebetween. The outer end wall 21 is rectangular (see FIG. 2). The outer end wall 21 rises upright perpendicularly to the bottom plate 10. On the upper edge portion of the outer end wall 21, the first intermediate plate 23 is provided continuously, with the folding line interposed therebetween. Moreover, on the first intermediate plate 23, the inner end wall 22 is provided continuously, with the folding line interposed therebetween. The inner end wall 22 is rectangular.

The inner end wall 22 is folded back to the inner surface side of the outer end wall 21, and is disposed perpendicularly to the bottom plate 10. The inner end wall 22 and the outer end wall 21 are disposed to be spaced from each other. The end wall 20 is formed in a hollow double wall. The lower edge portion of the inner end wall 22 comes in contact with an upper surface of the bottom plate 10. The inner end wall 22 includes a first engagement portion 25 which protrudes from the lower edge portion thereof and is inserted into the first engagement hole 11 of the bottom plate 10. In this way, the lower edge portion of the inner end wall 22 is fixed on the bottom plate 10.

The lower edge portion of the inner end wall 22 has left and right recessed portions 26, 26. Both recessed portions 26, 26 are disposed to be spaced from each other with a center portion of the inner end wall 22 in the left-right direction interposed therebetween. Each recessed portion 26 is a portion formed by recessing the lower edge portion of the inner end wall 22 and is substantially rectangular.

On the lower edge portion of the inner end wall 22, the first flap 24 is provided continuously, with the folding line interposed therebetween in a portion other than the first engagement portion 25 and both recessed portions 26, 26. The first flap 24 is a band-shaped portion extending in the left-right direction. The first flap 24 is folded inward relative to the inner end wall 22, and is overlaid on the upper surface of the bottom plate 10.

The first intermediate plate 23 is disposed between the upper edge portion of the outer end wall 21 and the upper edge portion of the inner end wall 22. The first intermediate plate 23 is a band-shaped portion extending in the left-right direction. The first intermediate plate 23 includes left and right opening portions 27, 27 opened therein. Both opening portions 27, 27 are disposed to be spaced from each other with the center portion of the first intermediate plate 23 in the left-right direction interposed therebetween. The length of the opening portion 27 in the front-rear direction is equal to the length of the first intermediate plate 23 in the front-rear direction.

In an opening edge portion of the opening portion 27, a rib plate 28 is provided continuously on the edge portion of the first intermediate plate 23 on the center side, with the folding line interposed therebetween. The rib plate 28 is folded downward relative to the first intermediate plate 23. The rib plate 28 is inserted between the outer end wall 21 and the inner end wall 22.

The end wall 20 on the rear side is formed symmetrically with the end wall 20 on the front side in the front-rear direction. The end wall 20 on the rear side includes an outer end wall 21 provided continuously on the rear edge portion of the bottom plate 10 and an inner end wall 22 folded back inward of the outer end wall 21. The lower edge portion of the inner end wall 22 has left and right recessed portions 26, 26.

As shown in FIG. 1, the side wall 30 on the left side includes an outside wall 31 provided continuously on the left edge portion of the bottom plate 10. This side wall 30 includes an inside wall 32 disposed on an inner side (right side) of an outside wall 31. The side wall 30 includes a second intermediate plate 33 disposed between the upper edge portion of the outside wall 31 and the upper edge portion of the inside wall 32. The side wall 30 incudes a second flap 34 provided continuously on the lower edge portion of the inside wall 32.

As shown in FIG. 5, the outside wall 31 is provided continuously on the left edge portion of the bottom plate 10, with the folding line interposed therebetween. The outside wall 31 is rectangular. The outside wall 31 rises upright perpendicularly to the bottom plate 10. The side wall 30 includes inner flaps 35, 35 which are provided continuously on the front and rear edge portions of the outside wall 31, with the folding lines interposed therebetween, respectively. The side wall 30 includes an upper flap 36 provided continuously on the upper edge portion of the inner flap 35 with a folding line being interposed therebetween. As shown in FIG. 6, the inner flap 35 is folded relative to the outside wall 31, and is overlaid on an inner surface of the outer end wall 21 of the end wall 20. The upper flap 36 is folded relative to the inner flap 35, and is overlaid on the lower surface of the first intermediate plate 23 of the end wall 20. In this way, the inner flap 35 and the upper flap 36 provided continuously on the outside wall 31 of the side wall 30 are disposed between the outer end wall 21 and the inner end wall 22 of the end wall 20. In this way, the end wall 20 and the side wall 30 are joined together.

As shown in FIG. 1, the side wall 30 includes protruding portions 37, 37 protruding upward from front and rear end portions of the upper edge portion of the outside wall 31. The side wall 30 includes a second intermediate plate 33 on the upper edge portion of the outside wall 31, and the second intermediate plate 33 is provided continuously between both protruding portions 37, 37, with the folding line interposed therebetween. Moreover, the side wall 30 includes an inside wall 32 provided continuously on the second intermediate plate 33, with the folding line interposed therebetween. The inside wall 32 is rectangular. The length of the inside wall 32 in the front-rear direction is slightly smaller than the interval between the front and rear inner end walls 22, 22.

The inside wall 32 is folded back to the inner surface side of the outside wall 31. The inside wall 32 has entered between the front and rear, two inner end walls 22, 22. The inside wall 32 and the outside wall 31 are disposed to be spaced from each other. That is, the side wall 30 has a hollow double wall.

The second intermediate plate 33 is disposed between the upper edge portion of the outside wall 31 and the upper edge portion of the inside wall 32. The second intermediate plate 33 is a band-shaped portion extending in the front-rear direction. The length of the second intermediate plate 33 of the side wall 30 in the front-rear direction is larger than the length of the inside wall 32 in the front-rear direction. The front and rear end portions of the second intermediate plate 33 are overlaid on upper surfaces of the first intermediate plates 23, 23 of the front and rear end walls 20, 20, respectively.

The inside wall 32 includes center portions of the entire upper portion and the lower portion which are disposed perpendicularly to the upper surface of the bottom plate 10. The inside wall 32 includes a lower edge portion which contacts with the upper surface of the bottom plate 10. The inside wall 32 includes a second engagement portion 38 which protrudes from the lower edge portion of the inside wall 32 and is inserted in the second engagement hole 12 of the bottom plate 10. In this way, the lower edge portion of the inside wall 32 is fixed on the bottom plate 10.

The inside wall 32 includes front and rear inclined supporting portions 50, 50 disposed on a front portion and a rear portion of the lower portion of the inside wall 32, respectively. Both the inclined supporting portions 50, 50 include upper edges which are provided continuously on the upper portion of the inside wall 32, with the folding lines interposed therebetween. Each inclined supporting portion 50 is folded relative to the upper portion of the inside wall 32. Each inclined supporting portion 50 is inclined relative to the outside wall 31 such that each inclined supporting portion 50 is further from the outside wall 31 as extending downward to the bottom plate 10. Each inclined supporting portion 50 includes a lower edge portion which contact with the upper surface of the bottom plate 10. As shown in FIG. 3, each inclined supporting portion 50 projects from the inside wall 32 to the inner space. Each inclined supporting portion 50 is a portion for supporting a lower surface of a content P housed in an upper space of the cushioning material 1.

As shown in FIG. 1, the second flaps 34 are provided continuously on the lower edge portions of the front and rear inclined supporting portions 50, 50, with the folding lines interposed therebetween. The second flap 34 is a band-shaped portion extending in the front-rear direction. The second flap 34 is folded inward relative to the inclined supporting portion 50. The second flap 34 is overlaid on the bottom surface of the bottom plate 10.

The length of the second flap 34 in the front-rear direction is larger than the length of the inside wall 32 in the front-rear direction. Then, the front and rear end portions 34*a*, 34*a* of the second flap 34 are inserted in the recessed portions 26, 26 formed in the lower edge portion of the front and rear inner end walls 22, 22, respectively. The second flap 34 has a folding line L1 which extends in the left-right direction and is disposed between an intermediate portion 34*b* and the end portion 34*a* of the second flap 34 (see FIG. 2).

The side wall 30 on the right side is symmetrical with the side wall 30 on the left side in the left-right direction. The side wall 30 on the right side includes an outside wall 31 provided continuously on the right edge portion of the bottom plate 10 and an inside wall 32 disposed inside the outside wall 31. Each side wall 30 includes front and rear inclined supporting portions 50, 50 disposed on the inside wall 32. Each side wall 30 includes a second flap 34 is provided continuously on the lower edge portion of the inclined supporting portion 50. The second flap 34 includes front and rear end portions 34*a*, 34*a* which are inserted in recessed portions 26, 26 of the front and rear inner end walls 22, 22, respectively.

Next, a method for assembling the cushioning material 1 of the present embodiment will be described. First, as shown in FIG. 5, from the form of the blank sheet S shown in FIG. 2, the left and right outside walls 31, 31 are raised upright relative to the bottom plate 10. The front and rear inner flaps 35, 35 are folded relative to the outside wall 31, and the upper flap 36 is folded relative to the inner flap 35. Subsequently, as shown in FIG. 6, the front and rear outer end walls 21, 21 are raised upright relative to the bottom plate 10. Moreover, each inner end wall 22 is folded back relative to the outer end wall 21, and the first engagement portion 25 of each inner end wall 22 is inserted into the first engagement hole 11 of the bottom plate 10. In this way, the lower edge portion of each inner end wall 22 is fixed on the bottom plate 10.

Thereafter, as shown in FIG. 1, the inside wall 32 is folded back relative to the outside wall 31. The second engagement portion 38 of the inside wall 32 is inserted into the second engagement hole 12 of the bottom plate 10. In this way, the lower edge portion of the inside wall 32 is fixed on the bottom plate 10. Both the end portions 34*a*, 34*a* of the second flap 34 provided continuously on the lower edge portion of the inside wall 32 are inserted into the recessed portions 26, 26 of the front and rear inner end walls 22, 22, respectively. At this time, each end portion 34*a* is folded along the folding line L1 relative to the intermediate portion 34*b* of the second flap 34. In this way, each end portion 34*a* can be easily inserted into the recessed portion 26.

In this way, as shown in FIG. 3, each second flap 34 is overlaid on the upper surface of the bottom plate 10 on the inner side relative to the inside wall 32, and is fixed to the bottom plate 10. When each second flap 34 is positioned on the bottom plate 10, both the inclined supporting portions 50, 50 are brought into a position where each inclined supporting portion 50 is inclined relative to the outside wall 31 such that each inclined supporting portion 50 is further from the outside wall 31 as extending downward to the bottom plate 10. In this way, the cushioning material 1 shown in FIG. 1 is assembled.

In the cushioning material 1 as described above, as shown in FIG. 3, when the content P is housed in the upper space, the lower surface of the content P is supported by each inclined supporting portion 50. In the present embodiment, the content P is fitted in the upper space of the cushioning material 1. In this way, the left and right edge portions of the lower surface of the content P are supported by the upper edge portions of the left and right inclined supporting portions 50, 50 respectively.

As described above, in the cushioning material 1 of the present embodiment, the content P can be supported in the upper space with being apart from the bottom plate 10 by each inclined supporting portion 50 projecting from the side wall 30. In this way, a space is defined between the content P and the bottom plate 10. In the cushioning material 1 of the present embodiment, as shown in FIG. 1, each end wall 20 and each side wall 30 are hollow double walls. The cushioning material 1 of the present embodiment as described above enhances the performance of protecting the content P against impact exerting on the box body 3 (see FIG. 4).

In the cushioning material 1 of the present embodiment, as shown in FIG. 1, the end portion 34*a* of each second flap 34 provided continuously on the inclined supporting portion 50 is inserted into the recessed portion 26 of the end wall 20. This insertion allows the lower edge portion of the inclined supporting portion 50 to be fixed, and this maintains the inclined supporting portion 50 in the inclined position. In this way, the cushioning material 1 of the present embodiment maintains the shape of the inclined supporting portion 50.

In addition, in the end wall 20 of the cushioning material 1 of the present embodiment, as shown in FIG. 1, the rib plate 28 is folded downward relative to the first intermediate plate 23, and is inserted between the outer end wall 21 and the inner end wall 22. This enhances the strength of the end wall 20 against a pressure in the lateral direction.

Note that in the present embodiment, as shown in FIG. 4, the container tray 2 is overlaid on the upper side of the cushioning material 1, and with this configuration the cushioning material 1 and the container tray 2 are housed in the box body 3. When the container tray 2 is overlaid on the cushioning material 1 of the present embodiment, the side surfaces of the container tray 2 are held by the respective protruding portions 37 protruding from the upper edge portions of both outside walls 31, 31. For this reason, the container tray 29 is difficult to displace relative to the cushioning material 1. This facilitates inserting the cushioning material 1 and the container tray 2, which are being overlaid on each other, into the box body 3.

In the cushioning material 1 of the present embodiment, each recessed portion 26 is formed in the lower edge portion of the inner end wall 22 of the end wall 20, which is a double wall. For this reason, when the end portion 34*a* of the second flap 34 is inserted into the recessed portion 26, the end portion 34*a* of the second flap 34 does not protrude from the outer surface of the end wall 20.

Although the present embodiment has been described so far, the present invention is not limited to the embodiment and can be modified without departing from the gist of the present invention. In the cushioning material 1 of the present embodiment, as shown in FIG. 3, the content P, which is an electronic device, can be housed; however, the type and number of contents which can be housed in this cushioning material are not limited. In addition, the number and inclination angle of the inclined supporting portions 50 are not limited, and are set as appropriate in conformity with the shape of contents to be housed.

In the cushioning material 1 of the present embodiment, as shown in FIG. 1, each end wall 20 is formed in a double wall with the outer end wall 21 and the inner end wall 22, and each rib plate 28 is inserted between the outer end wall 21 and the inner end wall 22. However, the rib plate 28 does not have to be provided. Furthermore, the end wall 20 may be a single wall body.

Although the cushioning material 1 of the present embodiment is made of a cardboard, the cushioning material may be formed of various known paperboards.

What is claimed is:

1. A cushioning material to be housed in a box comprising:

a bottom plate;

front and rear end walls standing upright from front and rear edge portions of the bottom plate respectively;

left and right side walls standing upright from left and right edge portions of the bottom plate respectively;

wherein each side wall includes:

an outside wall disposed continuously on an edge portion of the bottom plate; and an inside wall provided continuously on an upper edge portion of the outside wall and folded back to an inner surface side of the outside wall, wherein the inside wall includes a lower portion which includes an inclined supporting portion which is configured to support a lower surface of a content and hold the content with the content being apart from the bottom plate, wherein the inclined supporting portion is inclined relative to the outside wall such that the inclined supporting portion is further from the outside wall as extending downward to the bottom plate, wherein the inside wall includes a flap provided continuously on a lower edge portion of the inclined supporting portion and the flap is overlaid on an upper surface of the bottom plate, wherein the flap includes an end portion in a front-rear direction and the end portion is inserted in a recessed portion defined by a lower edge portion of each end wall.

2. The cushioning material according to claim 1, wherein each end wall includes:

an outer end wall provided continuously on the edge portion of the bottom plate; and an inner end wall provided continuously on an upper edge portion of the outer end wall and folded back to the inner surface side of the outer end wall, wherein the recessed portion is defined by a lower edge portion of the inner end wall.

3. The cushioning material according to claim 2, wherein each end wall includes an intermediate plate disposed between an upper edge portion of the outer end wall and an upper edge portion of the inner end wall, wherein the intermediate plate defines an opening portion, wherein each end wall includes a rib plate provided continuously on an edge portion of the opening portion, and wherein the rib plate is folded downward relative to the intermediate plate and inserted between the outer end wall and the inner end wall.

* * * * *